US006283809B1

(12) United States Patent
Takase et al.

(10) Patent No.: US 6,283,809 B1
(45) Date of Patent: Sep. 4, 2001

(54) OUTBOARD MOTOR EXHAUST SYSTEM

(75) Inventors: Hiroaki Takase; Tomohiro Nozawa; Junichi Hasegawa, all of Shizuoka (JP)

(73) Assignee: Sanshin Kogyo Kabushiki Kaisha, Shizuoka (JP)

( * ) Notice: Subject to any disclaimer, the term of this patent is extended or adjusted under 35 U.S.C. 154(b) by 0 days.

(21) Appl. No.: 09/558,765

(22) Filed: Apr. 26, 2000

(30) Foreign Application Priority Data

Apr. 26, 1999 (JP) ..... 11-118173

(51) Int. Cl.[7] ..... B63H 21/32
(52) U.S. Cl. ..... 440/89; 440/76; 440/77
(58) Field of Search ..... 440/88, 89, 77, 440/76; 123/195 P

(56) References Cited

U.S. PATENT DOCUMENTS 4,604,069 8/1986 Taguchi .
4,607,723 8/1986 Okazaki .
4,963,110 10/1990 Otani et al. .
5,103,931 4/1992 Okazaki et al. .
5,326,295 7/1994 Nakayama .
5,494,467 * 2/1996 Sohgawa et al. ..... 440/89
5,743,774 * 4/1998 Adachi et al. ..... 440/89
6,027,385 2/2000 Katayama et al. .

FOREIGN PATENT DOCUMENTS 2678920 11/1997 (JP) .

* cited by examiner

*Primary Examiner*—Ed Swinehart
(74) *Attorney, Agent, or Firm*—Knobbe, Martens, Olson & Bear, LLP

(57) ABSTRACT

An exhaust system for an outboard motor includes an improved construction that can reduce cost for providing an expansion chamber of an idle exhaust discharge. The outboard motor includes an engine and a protective cowling that surrounds the engine. The protective cowling includes a top and bottom cowling members. The expansion chamber of the idle exhaust route is defined by at least a bottom surface of the bottom cowling member and a separable member.

27 Claims, 6 Drawing Sheets

OUTBOARD MOTOR EXHAUST SYSTEM

PRIORITY INFORMATION

This application is based on and claims priority to Japanese Patent Application No. Hei 11-118173, filed Apr. 26, 1999.

BACKGROUND OF THE INVENTION

1. Field of the Invention

This invention relates to an exhaust system for an outboard motor, and more particularly to an improved exhaust system that discharges exhaust gases to the atmosphere.

2. Description of Related Art

Typical outboard motors have engines atop thereof for powering propulsion devices and protective cowlings surround the engines. The engines are provided with exhaust systems that discharge exhaust gases.

A typical exhaust system includes a main exhaust route that discharges exhaust gases via a submerged main exhaust port to the body of water in which the outboard motor operates (usually through the propeller hub), and an idle exhaust route that discharges the gases to the atmosphere via an above-water idle discharge port. When the outboard motor runs at a normal speed, the exhaust gases are discharged through both the main and idle exhaust routes. When the outboard motor runs the watercraft at a relatively low speed or the engine is just idling, the exhaust gases are discharged only through the idle exhaust route due to backpressure at the submerged main exhaust port.

The exhaust gases generally hold large amounts of energy that manifest in exhaust noise. One of significant issue for outboard motor design involves how to treat the exhaust noise. As to the main exhaust route, the exhaust noise treatment is relatively easy because the motor can have a plurality of expansion chambers en route to a discharge port. Additionally, the water body itself silences the exhaust noise as energy is dissipated in the water. The noise treatment, however, is a serious problem with the idle exhaust route due in part to the fact that the route is normally contained in a relatively narrow space. Moreover, the idle route must discharge the gases directly to the atmosphere.

Expansion chambers have been previously used in the idle exhaust route to silence exhaust noise before discharge. For example, U.S. Pat. No. 4,963,110 discloses an exhaust system that has a detachable expansion chamber mounted on an engine for the idle exhaust route. The exhaust gases are led to the expansion chamber en route to the discharge port of the idle exhaust route and expanded before discharged to the atmosphere. Japanese Patent No. 2678920 also discloses an exhaust system that has an expansion chamber for the idle exhaust route. The expansion chamber is a cylindrically shaped member that is mounted on an outer surface of a driveshaft housing. The expansion chamber communicates with the main expansion route and also with the atmosphere via the idle exhaust port.

Idle exhaust noise can be reduced because of such expansion chambers; however, such a detachable chamber or a cylindrical member raises production costs. A need therefore exists for an improved exhaust system that can reduce cost for providing an expansion chamber within an idle exhaust route.

SUMMARY OF THE INVENTION

In accordance with one aspect of the present invention, an outboard motor comprises an internal combustion engine powering a propulsion device. A protective cowling surrounds the engine. An exhaust system includes a discharge route through which exhaust gases are discharged to the atmosphere from the engine. The discharge route has an expansion chamber for the exhaust gases defined by at least a bottom surface of the protective cowling and a separable member.

Further aspects, features and advantages of this invention will become apparent from the detailed description of the preferred embodiments which follows.

BRIEF DESCRIPTION OF THE DRAWINGS

These and other features of this invention will now be described with reference to the drawings of a preferred embodiment which are intended to illustrate and not to limit the invention.

DETAILED DESCRIPTION OF THE PREFERRED EMBODIMENT OF THE INVENTION

Figure 1:
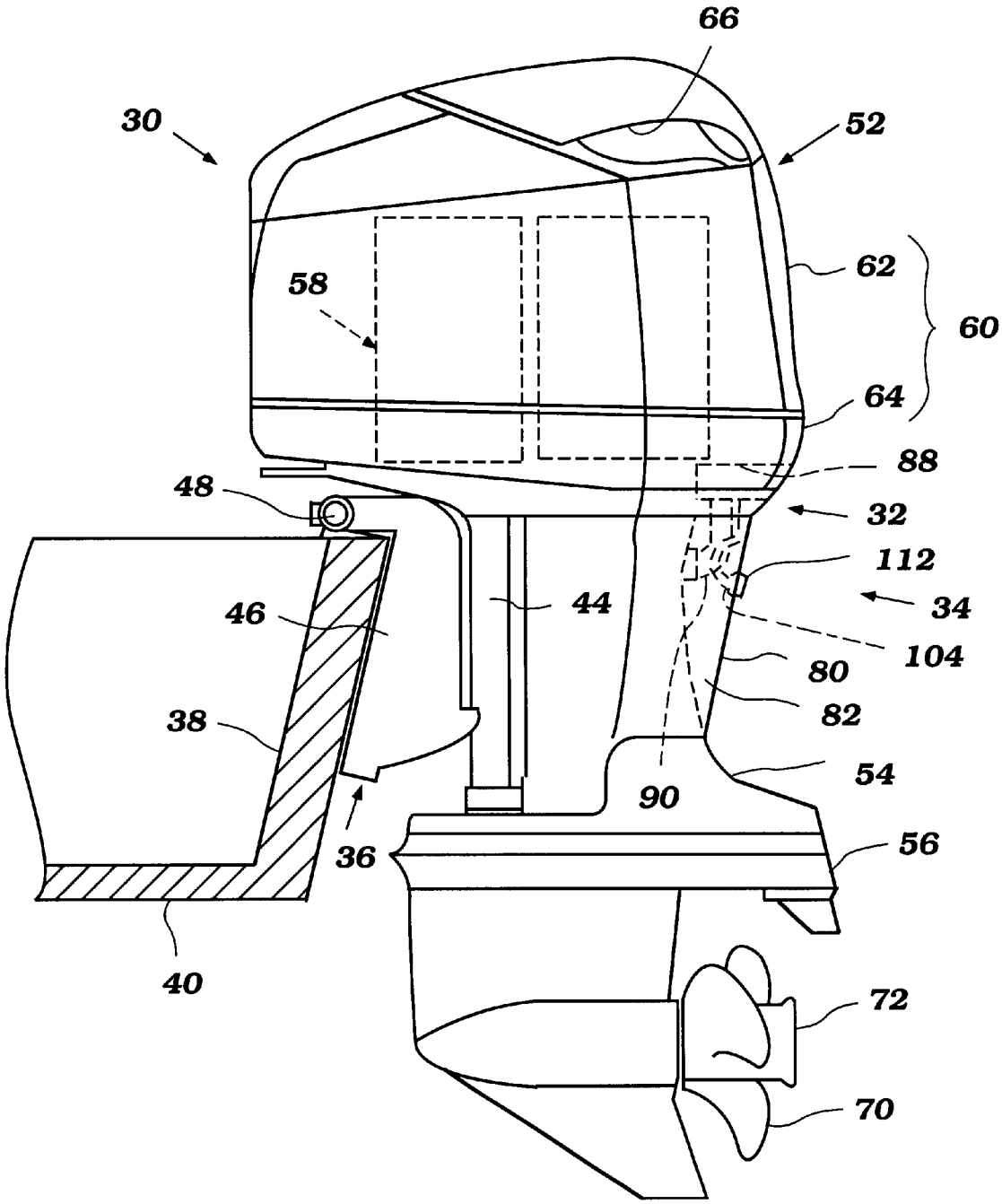
FIG. 1 is a side elevational view of an outboard motor having an exhaust system configured in accordance with a preferred embodiment of the present invention. An associated watercraft is shown partially and in section.

With reference to FIG. 1, an outboard motor 30 incorporates an exhaust system having an idle exhaust route 32 configured in accordance with a preferred embodiment of the present invention. Although the present invention has particular applicability in connection with an outboard motor, and therefore is described in this context, cerain aspects of the present invention can be used with other marine drive units as well.

The outboard motor 30 comprises a drive unit 34 and a bracket assembly 36. The bracket assembly 36 supports the drive unit 34 on a transom 38 of an associated watercraft 40 so as to place a marine propulsion device of the drive unit 34 in a submerged position with the watercraft 40 resting on the surface of a body of water. The bracket assembly 36 comprises a swivel bracket 44, a clamping bracket 46, a steering shaft and a pivot pin 48.

The steering shaft extends through the swivel bracket 44 and is affixed to the drive unit 34. The steering shaft is pivotally journaled for steering movement about a generally vertically extending steering axis within the swivel bracket 44. The clamping bracket 46 includes a pair of bracket arms spaced apart from each other and affixed to the watercraft transom 38. The pivot pin 48 completes a hinge coupling between the swivel bracket 44 and the clamping bracket 46. The pivot pin 48 extends through the bracket arms so that the clamping bracket 46 supports the swivel bracket 38 for pivotal movement about a generally horizontally extending tilt axis of the pivot pin 48.

As used through this description, the terms "front," forward" and "forwardly" mean at or to the side where the clamping bracket 46 is located, and the terms "reverse," "rear," "rearward" and "rearwardly" mean at or to the opposite side of the front side, unless indicated otherwise.

Although not shown, the bracket assembly 36 can also include a hydraulic tilt system that is provided between the swivel bracket 44 and clamping bracket 46. This system tilts up and down and also adjusts the trim position of the drive unit 34. Since the construction of the bracket assembly 36 is well known in the art, further description is not believed to be necessary to permit those skilled in the art to practice the present invention.

The drive unit 34 includes a power head 52, a driveshaft housing 54 and a lower unit 56. The power head 52 is disposed atop of the drive unit 34 and includes an internal combustion engine 58 and a protective cowling assembly 60. The protective cowling assembly 60 includes a top cowling member 62 and a bottom cowling member 64. The top cowling member 62 preferably is made of synthetic resin, while the bottom cowling member 64 is preferably made of metal such as aluminum alloy.

The cowling assembly 60 generally completely surrounds the engine 58. That is, the cowling assembly 60 defines a generally closed cavity that contains the engine 58. The top cowling member 62 is detachably affixed to the bottom cowling member 64 so that the operator can make access to the engine 58 for maintenance or other purposes. The top cowling member 62 is provided with an air intake construction that desirably has a pair of air intake openings 66 on both rear sides of the top cowling member 62. The air intake construction introduces the ambient air into the cavity through the openings 66.

The bottom cowling member 64 has an opening at its bottom portion through which an exhaust guide extends. The exhaust guide is affixed atop the driveshaft housing 54. The bottom cowling member 64 and the exhaust guide, thus, generally form a tray. The engine 58 is placed on this tray and is affixed to the exhaust guide. The exhaust guide also has an exhaust passage that forms a portion of the exhaust system, which will be described in detail below.

The engine 58 operates on, for example, a four-stroke combustion principle and powers a propulsion device. However, other types of engines that have other number of cylinders, other cylinder arrangements and operate on other combustion principles (e.g., crankcase compression two-stroke or rotary) are all practicable.

The engine 58 includes at least an air induction system and a fuiel supply system, and preferably a firing system. The air induction system supplies the air introduced into the cavity of the cowling assembly 60 to a combustion chamber (s). The induction system has a measurement mechanism including a throttle valve(s) that can regulate an air amount for each combustion in response to various conditions of the engine operations. The fuel supply system includes, for example, a fuel injection device or carburetor each to supply a proper amount of fuel charge to the combustion chamber (s) in proportion to the air amount so as to keep an optimum air/fuel ratio. The firing system preferably includes a spark plug(s) that fires the air fuel charge in the combustion chamber(s). The engine 58 has a piston(s) reciprocally moveable within a cylinder bore(s) of the engine 58. The air/fuel charge fired by the spark plug(s) burns and abruptly increases its volume to reciprocally move of the piston(s) in a known manner. The piston(s) is connected to a crankshaft by a connecting rod(s) and thus the reciprocal movement of the piston(s) rotates the crankshaft.

The engine 58 can have an engine control unit (ECU) that electrically control the injection timing and duration of fuel, if the engine 58 employs a fuel injection system, and also the firing timing based upon signals sent from various sensors so that optimum engine operation can be achieved.

The engine 58 further has the exhaust system to discharge a burnt charge (i.e., exhaust gases) from the combustion chamber(s) and finally from the motor 30. The engine construction is well known except for the exhaust system that involves the idle exhaust route 32 configured in accordance with the embodiment of the present invention. Thus, further descriptions of the engine construction are not believed necessary to permit those skilled in the area to practice the invention.

The driveshaft housing 54 depends from the power head 52 and supports a driveshaft which is driven by the crankshaft of the engine 58. The driveshaft extends generally vertically through the exhaust guide and then driveshaft housing 54.

The lower unit 56, depends from the driveshaft housing 54 and supports a propulsion shaft which is driven by the driveshaft. The propulsion shaft extends generally horizontally through the lower unit 56 with the motor in a tilted down position. In the illustrated embodiment, the propulsion device includes a propeller 70 that is affixed to an outer end of the propulsion shaft and is driven by the propeller shaft. The propulsion device, however, can take the form of a dual, counter-rotating propeller system, a hydrodynamic jet, or a like propulsion device.

A transmission is provided between the driveshaft and the propeller shaft. The transmission couples together the two shafts which lie generally normal to each other (i.e., at a 90° shaft angle), via a bevel gear assembly or the like. The transmission has a switchover or clutch mechanism to shift rotational directions of the propeller 70 to forward, neutral or reverse. The switchover mechanism is operable by the operator through a shift linkage.

Still with reference to FIG. 1 and additionally reference to FIGS. 2 to 6, the exhaust system, particularly, its idle exhaust route 32, will now be described in great detail. The exhaust system, like a conventional exhaust system of an outboard motor, includes a main exhaust route that discharges the majority of the exhaust gases to the body of water through a hub 72 of the propeller 70. This main route extends from exhaust port(s) of the engine 58. The driveshaft housing 54 and the lower unit 56 define internal passages 74 that form portions of the main exhaust route. The exhaust passage formed within the exhaust guide couples the exhaust port(s) to the internal passages 74 of the driveshaft housing 54. The internal passages 74 include at least one expansion chamber to reduce the exhaust noise. Since any constructions of the conventional main exhaust route can be applied, no further description of this route is believed to be necessary.

The exhaust system additionally includes the idle exhaust route 32 that branches off the main exhaust route within the driveshaft housing 54 or at another location along the main exhaust route (e.g., within or above the exhaust guide). The idle exhaust route 32 is provided for discharging exhaust gases to the atmosphere from an area sufficiently above the water body. This is because, when the engine 58 runs at a relatively low speed or the engine 58 is just idling, a large part of the internal passages 74 is filled with water. Since the backpressure produced is higher than the exhaust pressure, the exhaust gases are not efficiently discharged through the propeller hub 72. When the outboard motor 30 runs at an increased speed, the backpressure is reduced. Thus, the exhaust gases are discharged through both the main route and the idle route 32.

Figure 2:
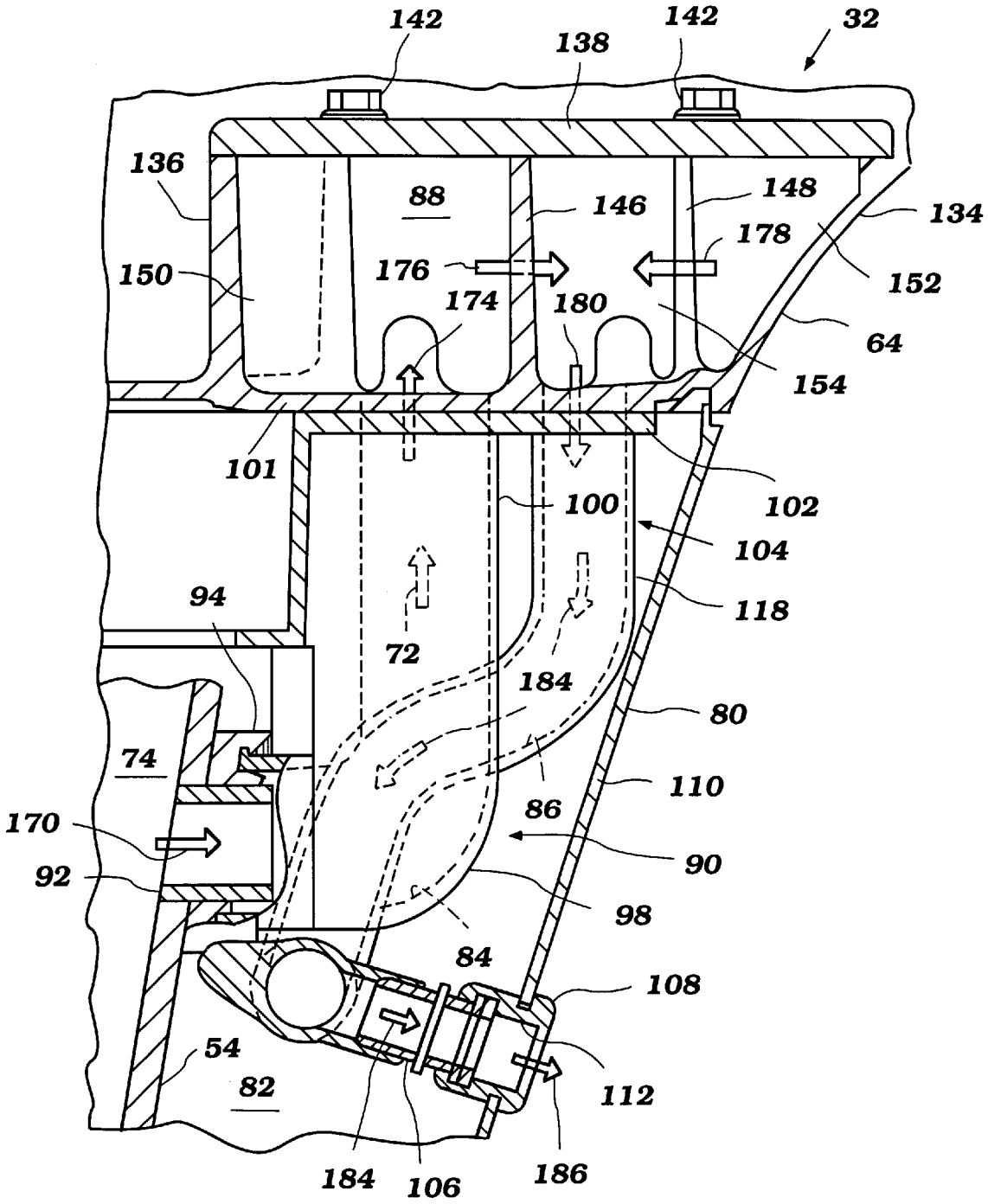
FIG. 2 is an enlarged cross-sectional view showing an idle exhaust route of the exhaust system. An expansion chamber is sectioned along the line 2—2 of FIG. 4.

As seen in FIG. 2, an apron 80 is affixed to a rear top portion of the driveshaft housing 54 to define a conduit space 82 with an outer surface of the driveshaft housing 54 and a bottom surface of the bottom cowling member 64. The idle exhaust route 32 generally comprises a delivery passage 84, discharge passage 86 and an expansion chamber 88. In the illustrated embodiment, the delivery passage 84 and the discharge passage 86 are provided within the conduit space 82, while the expansion chamber 88 is defined within the bottom cowling member 64.

The delivery passage 84 is generally defined by a delivery conduit unit 90 and coupling pipes 92 that extend rearward from the driveshaft housing 54 to couple the internal passage 74 to the delivery passage 84. A seal member 94, which is made of elastic material such as rubber, is interposed between the conduit unit 90 and the coupling pipes 92 so that exhaust gases do not leak out.

Figure 3:
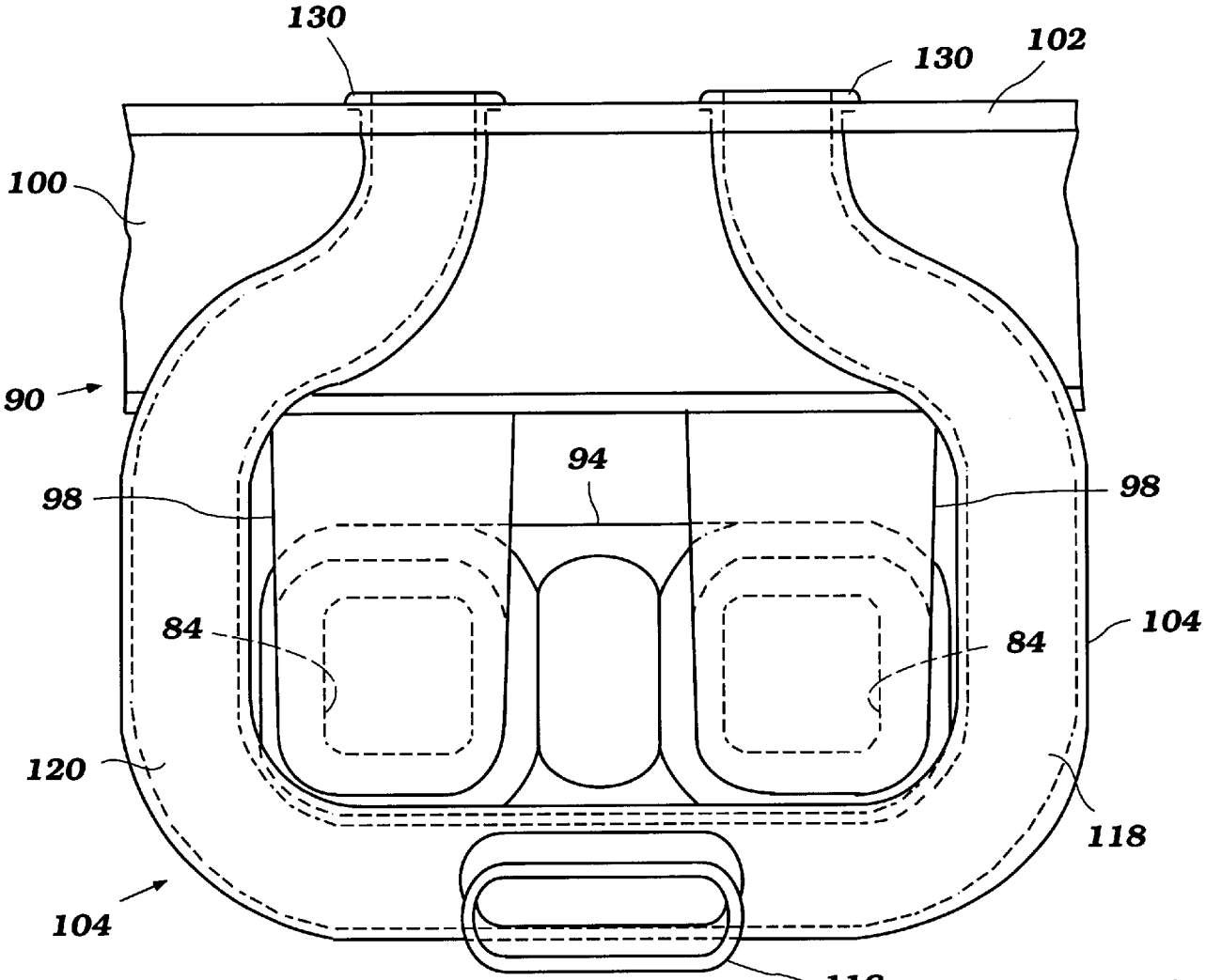
FIG. 3 is a rear view showing a delivery passage and a discharge passage, and also a combination thereof.

As best seen in FIG. 3, the delivery conduit unit 90 forms a manifold that includes a pair of duct sections 98 and a common section 100. The delivery passage 84 is defined in both of the duct sections 98 and then merges together in the common section 100. The upper end of the common section 100 has a flange 102 that is affixed to a bottom shell 101 of the bottom cowling member 64 by bolts (not shown). The upper end of the common section 100 has two inlet openings 103 (see FIG. 4) that communicate to the expansion chamber 88.

In the illustrated embodiment, the delivery conduit unit 90 preferably is made of metal (e.g., aluminum alloy) preferably by the die-casting method; however, it can be made of other materials as well (e.g., bard or soft synthetic resin or rubber), and also by the other known processes (e.g., by injection molding).

A discharge conduit unit 104, a coupling pipe 106 and a rubber joint 108 generally defines the discharge passage 86 in the illustrated embodiment. The rubberjoint 108 fits in a through-hole that is formed on the rear shell 110 of the apron 80 and defines an outlet opening 112 therein. The discharge conduit unit 104 has a lower opening section 116. The coupling pipe 106 couples the lower opening section 116 to the rubber joint 112.

Figure 5:
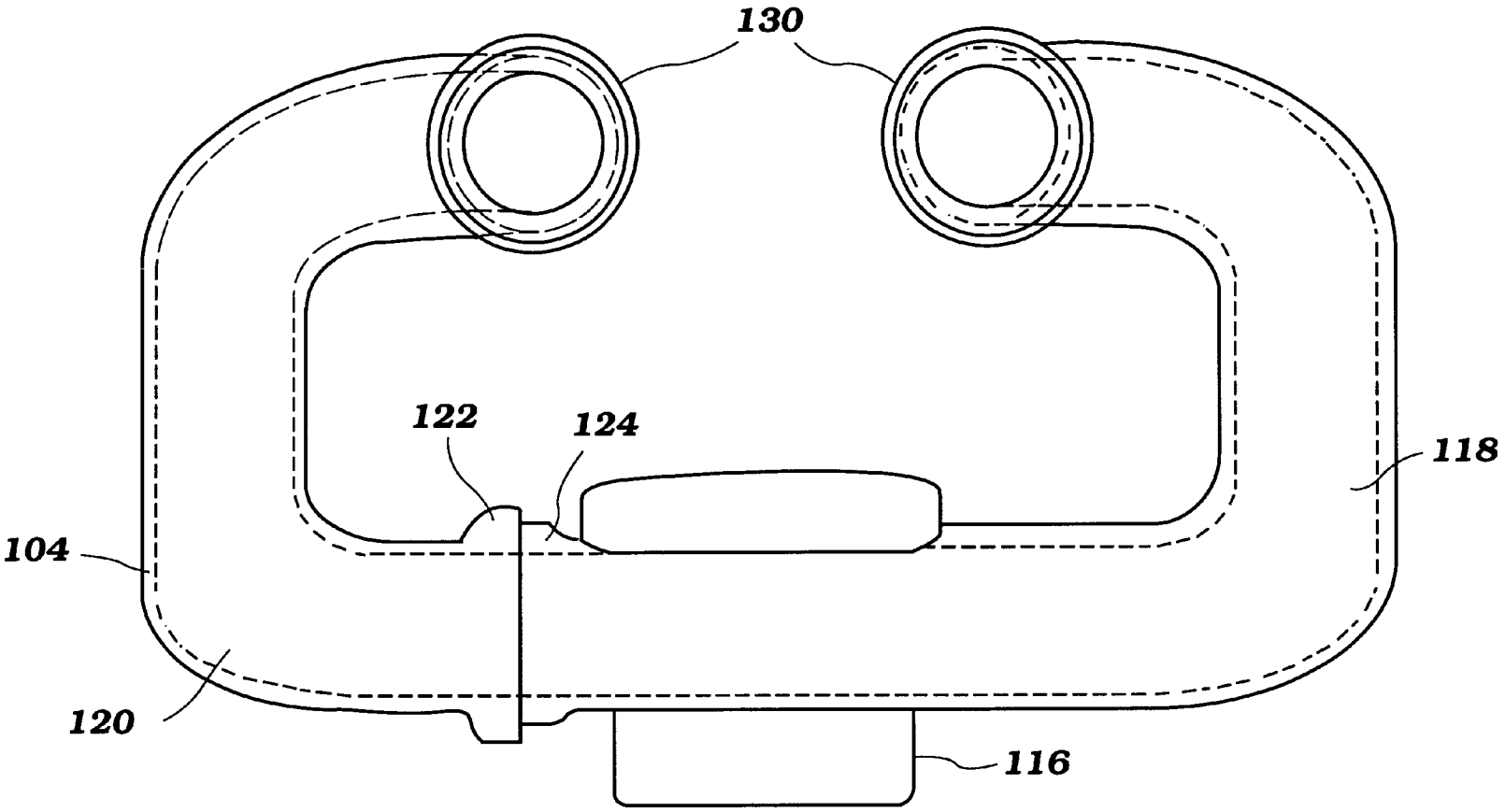
FIG. 5 is a top plan view of a discharge conduit unit that forms the discharge passage.
Figure 6:
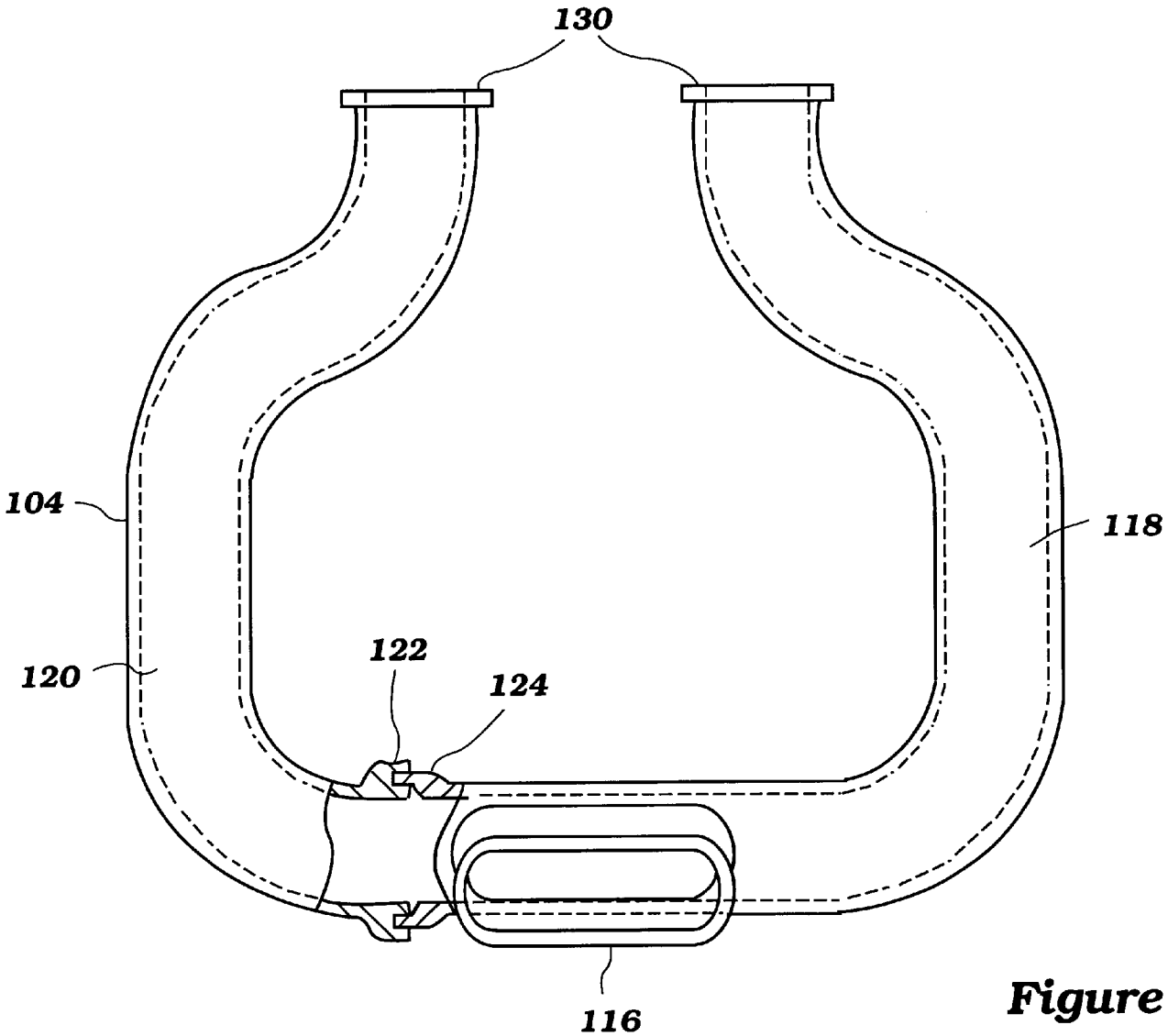
FIG. 6 is a rear view of the discharge conduit unit.

As seen in FIGS. 3, 5 and 6, the discharge conduit unit 104 bifurcates laterally and upwardly from the lower opening section 116 to form a pair of conduit sections 118, 120. Both the conduit sections 118, 120 adjacent to the opening section 116 extend generally horizontally and then upwardly. As best seen in FIG. 3, the respective conduit sections 118, 120 extend to either side of the duct sections 98 of the delivery conduit unit 90 so as to hold it therebetween. This arrangement is advantageous to contain both of the delivery conduit unit 90 and the discharge conduit unit 104 in the relatively narrow conduit space 82. In addition, the bifurcated conduit sections 118, 120 can comprehensively have a flow capacity that is equal to a single conduit which size is twice that of each conduit 118, 120, separately although their arrangement is far easier than the single conduit to fit within such a narrow space.

As seen in FIGS. 5 and 6, the conduit unit 104 is preferably formed with two pieces that are joined together. One of the pieces involves the opening section 116 and one conduit section 118, while the other piece involves only another conduit section 120. More specifically, the conduit section 120 has a female joint 122 and the conduit section 118 has a male joint 124. Then, both the joints 122, 124 are coupled together to unite both pieces. Incidentally, the joints 122, 124 are omitted in FIG. 3. However, the discharge conduit unit 104 can be formed as a single piece.

In the illustrated embodiment, the discharge conduit unit 104 is made of elastic and heat resistant material such as rubber or soft synthetic resin that has been treated to have the heat-resistant nature. Although it can be formed with hard synthetic resin or metal, the elastic nature is advantageous because the vibration energy of the exhaust gases which is one of the sources for the exhaust noise, can be absorbed by the conduit unit 104.

Figure 4:
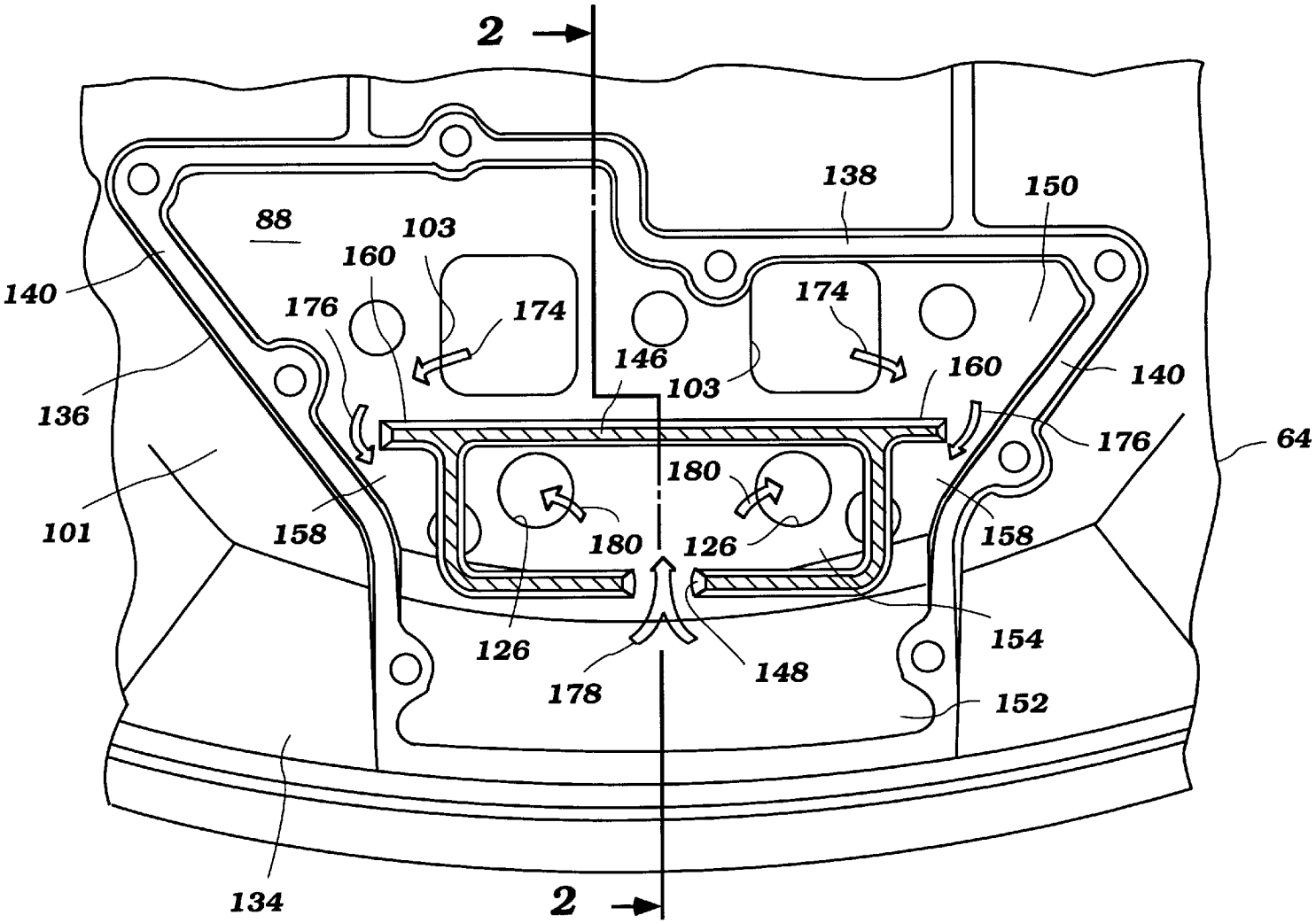
FIG. 4 is a top plan view of a bottom cowling member that contains the expansion chamber. A top member for the expansion chamber is detached. Although an internal partition in the expansion chamber is not actually sectioned, hatching is added to emphasize the partition.

As seen in FIG. 4, the bottom shell 101 of the bottom cowling member 64 has two outlet openings 126 that communicate to the expansion chamber 88. Both upper opening sections 130 of the discharge conduit unit 104 have flanges that are coupled to the outlet openings 126 so as to affix the discharge unit 104 to the bottom shell 101 of the bottom cowling member 64.

As best seen in FIG. 2, the expansion chamber 88 is generally defined by the bottom shell 101, a rear shell 134 of the bottom cowling member 64, a partition 136 and a top member 138. The bottom shell 101 and the rear shell 134 are not specially provided because the bottom cowling member 64 normally include them.

As seen in FIGS. 2 and 4, the partition 136 extends generally vertically from the bottom shell 101 and includes a front section 138 and a pair of lateral sections 140 as seen in FIG. 4. The front section 138 extends generally transversely, while the respective lateral sections 140 extends generally rearwardly, but become somewhat narrower toward the rear shell 134 of the bottom cowling member 64. The partition 136 in the illustrated embodiment is uniformly formed with the bottom cowling member by the die-casting method. However, it can be provided separately from the bottom shell 101 and/or the rear shell 134 and then attached.

The top member 138 is separable and is affixed to the partition 136 by a plurality of bolts 142. In the illustrated embodiment, eight bolts 142 are used.

As best seen in FIG. 4, in the illustrated embodiment, an internal partition 146 additionally extends generally vertically from the bottom shell 101 so as to be positioned generally at the center of the expansion chamber 88. The internal partition 146 is configured generally as a rectangular shape that has a longer side extending transversely. However, a slot 148 is formed on its rear side to incomplete the rectangular shape.

As seen in FIG. 2, the internal partition 146 is exactly the same as the outer partition 136 in height. Thus, the internal partition 146 divides the expansion chamber 88 into three expansion compartments, i.e., a first, second and third compartment 150, 152, 154. Because of the narrower shapes of the lateral sections 140, either portion between the lateral section 140 and the inner partition 146 is formed as a strait 158. In order to make the straits 158 narrower, the internal partition 146 in the illustrated embodiment has projections 160 extending towards the respective lateral sections 140. The slot 148 can also act as a strait. The straits 158 couple the first compartment 150 to the second compartment 152, while the slot 148 couples the second compartment 148 to the third compartment 154.

The third compartment 154 abuts the first compartment 150 beyond the internal partition 146. In other words, the first and second compartments 150, 152 interpose the third compartment 154 therebetween. Exhaust gases, therefore, flow into the third compartment from the second compartment in a direction that is generally opposite to a direction in which the exhaust gases flow into the second compartment 152 from the first compartment 150. Accordingly, the expansion chamber 88 in this embodiment has a turnover, multiple expansion type structure.

When the engine 58 operates under normal running conditions, the majority of the exhaust gases are discharged to the body of water through the main exhaust route. The exhaust gases discharged from the combustion chamber(s) pass through the exhaust port(s), the exhaust passage in the exhaust guide and the internal passages 74 in the driveshaft housing 64 and the lower unit 56. The expansion chamber(s) included in the internal passages 74 reduces the exhaust noise because the exhaust gases lose energy by abruptly expanding. The exhaust gases then go to the propeller hub 72 and finally outward to the body of water. Some of the exhaust gases branch off to the idle exhaust route 32 and are discharged to the atmosphere in the same manner as described below.

When the engine 58 operates at a relatively slow speed or at idle, the exhaust gas flow through the main exhaust route is impeded due to backpressure and the majority of the exhaust gases flow through the idle exhaust route 32. The exhaust gases pass through the coupling pipe 92 as indicated by the arrow 170 of FIG. 2 and then go up toward the expansion chamber 88 through the delivery passage 84 formed in the delivery conduit unit 90 as indicated by the arrow 172. The exhaust gases enter the first expansion compartment 150 of the expansion chamber 88 through the inlet openings 103 as indicated by the arrows 174 of FIGS. 2 and 4. Under this condition, the exhaust gases undergo a first expansion to reduce the noise. The exhaust gases then go to the second expansion compartment 152 through the straits 158 as indicated by the arrows 176 of FIGS. 2 and 4. The straits 158 squeeze the gases. The exhaust gases again expand in the second compartment 152 and enter the third expansion compartment 154 through the slot 148 as indicated by the arrows 178 of FIGS. 2 and 4. Like the straits 158, the slot 148 squeezes the gases. The gases, however, again expand in the third compartment 154. Then, the exhaust gases pass through the outlet openings 126 of the expansion chamber 88 as indicated by the arrows 180 of FIGS. 2 and 4 toward the discharge passage 86 defined by the discharge conduit unit 104 and the coupling pipe 106. The gases then flow down to the outlet opening 112 defined by the rubber joint 108 through the discharge passage 86 as indicated by the arrows 184 and finally outward to the atmosphere as indicated by the arrow 186 of FIG. 2.

As described above, in this embodiment, the exhaust gases repeatedly undergo expansion three times within the expansion chamber 88. In addition, the gases must turnover once. During these processes, the exhaust gases lose much energy and hence the exhaust noise can be greatly reduced. Moreover, the discharge conduit unit 104, which preferably is made of elastic material, enhances the noise reduction because it is inflatable to absorb the vibration energy of the exhaust gases.

It should be noted, however, various other expansion and squeeze constructions can be applied within the expansion chamber 88. Also, the discharge conduit unit 104 may be made of hard material such as metal. Conversely, the delivery conduit unit 90 can be made of elastic material as noted above. It is also practicable and useful to cover or coat the entire or a part of inner surfaces of the members that define the expansion chamber 88.

As described above, in the illustrated embodiment, the major part that defines the expansion chamber is originally provided on the bottom cowling member, and only the small configuration change in the bottom cowling member and the separable member are necessary. Thus, the cost for providing the expansion chamber of the idle exhaust route can be greatly reduced.

In addition, no particular space needs to be created for positioning the expansion chamber because the rear space in the bottom cowling member generally has not been used previously for any particular purpose.

In the illustrated embodiment, both of the delivery and discharge units are placed in the conduit space formed between the outer surface of the driveshaft housing, bottom surface of the bottom cowling member and the apron. However, they can be positioned within the driveshaft housing either entirely or partly.

Of course, the foregoing description is that of a preferred embodiment of the invention, and various changes and modifications may be made without departing from the spirit and scope of the invention, as defined by the appended claims.

What is claimed is:

1. An outboard motor comprising an internal combustion engine powering a propulsion device, a protective cowling surrounding the engine, an exhaust system including a discharge route through which exhaust gases are discharged to the atmosphere from the engine, the discharge route having an expansion chamber for the exhaust gases defined by at least a bottom surface of the protective cowling and a separable member.

2. The outboard motor as set forth in claim 1, wherein a partition extending generally upward from the bottom surface additionally defines the expansion chamber.

3. The outboard motor as set forth in claim 2, wherein the partition is a portion of the protective cowling.

4. The outboard motor as set forth in claim 1, wherein an outer shell of the protective cowling additionally defines the expansion chamber.

5. The outboard motor as set forth in claim 4, wherein a rear outer shell of the protective cowling defines the expansion chamber.

6. The outboard motor as set forth in claim 1, wherein the protective cowling comprises a bottom cowling member and a top cowling member detachably affixed to the bottom cowling member, and the expansion chamber is defined within the bottom cowling member.

7. The outboard motor as set forth in claim 1, wherein the expansion chamber includes a plurality of expansion compartments.

8. The outboard motor as set forth in claim 1, wherein the expansion chamber includes at least a first, second and third expansion compartments, and the exhaust gases flow through the compartments in order of the first, second and third compartment.

9. The outboard motor as set forth in claim 8, wherein the first and second compartments generally interpose the third compartment therebetween, and the exhaust gases flow into the third compartment from the second compartment in a direction that is generally opposite to a direction in which the exhaust gases flow into the second compartment from the first compartment.

10. The outboard motor as set forth in claim 1 additionally comprising a driveshaft housing through which a driveshaft driving the propulsion device extends, the driveshaft housing being provided below the protective cowling, the exhaust system including an internal passage extending through the driveshaft housing, and the expansion chamber communicating with the internal passage.

11. The outboard motor as set forth in claim 10, wherein the driveshaft housing includes an apron covering an outer surface of the driveshaft housing, and the expansion chamber communicates with the internal passage via a delivery passage positioned between the outer surface of the driveshaft housing and the apron.

12. The outboard motor as set forth in claim 11, wherein the expansion chamber communicates with the atmosphere via a discharge passage positioned between the outer surface of the driveshaft housing and the apron.

13. The outboard motor as set forth in claim 12, wherein the discharge passage includes at least two discharge portions extending from either side of the delivery passage.

14. The outboard motor as set forth in claim 13, wherein the discharge portions are unified together to form a single outlet.

15. The outboard motor as set forth in claim 10, wherein the driveshaft housing including an apron covering an outer surface of the driveshaft housing, and the expansion chamber communicates with the atmosphere via a discharge passage positioned between the outer surface of the driveshaft housing and the apron.

16. The outboard motor as set forth in claim 1, wherein the expansion chamber communicates with the atmosphere via a discharge passage, and the discharge passage is formed with an elastic material.

17. An exhaust system for an outboard motor having an internal combustion engine, comprising a protective cowling configured to surround the engine, a discharge route configured to discharge exhaust gases to the atmosphere from the engine, the discharge route including an expansion chamber for the exhaust gases defined by at least a bottom surface of the protective cowling and a separable member.

18. An exhaust system for an internal combustion engine, comprising at least first, second, third and fourth components together defining an exhaust passage through which exhaust gases are discharged to the atmosphere from the engine, the first component arranged to support the engine, the second component arranged to surround the engine, the third component coupling the first component with the second component, the exhaust passage including an expansion chamber, the second and fourth components together defining the expansion chamber.

19. The exhaust system as set forth in claim 18, wherein the fourth component is detachably coupled with the second component.

20. The exhaust system as set forth in claim 18, wherein the third component extends out of the first component.

21. The exhaust system as set forth in claim 20 additionally comprising a cover member configured to cover the third component, wherein the third component is disposed between the first component and the cover member.

22. The exhaust system as set forth in claim 18 additionally comprising a fifth component extending downstream of the expansion chamber and configured to discharge the exhaust gases from the expansion chamber.

23. The exhaust system as set forth in claim 18, wherein the expansion chamber includes at least a first, second and third expansion compartments which are configured such that the exhaust gases flow through the compartments in order of the first second, and third compartment.

24. The exhaust system as set forth in claim 23, wherein the first and second compartments generally interpose the third compartment therebetween, and the exhaust gases flow into the third compartment from the second compartment in a direction that is generally opposite to a direction in which the exhaust gases flow into the second compartment from the first compartment.

25. An outboard motor comprising an internal combustion engine powering a propulsion device, a cowling assembly surrounding the engine, the cowling assembly including a bottom cowling member and a top cowling member detachably coupled with the bottom cowling member, the bottom cowling member having a portion defining, at least in part, means for expanding and routing exhaust gasses to the atmosphere.

26. The outboard motor as set forth in claim 25, wherein the means for expanding includes a detachable member detachably affixed to the bottom cowling member.

27. The outboard motor as set forth in claim 26, wherein the detachable member is removable generally upwardly from the bottom cowling member.

* * * * *